US007766448B2

(12) United States Patent
Ito

(10) Patent No.: US 7,766,448 B2
(45) Date of Patent: Aug. 3, 2010

(54) INK-JET HEAD

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 461 days.

(21) Appl. No.: 11/747,430

(22) Filed: May 11, 2007

(65) Prior Publication Data

US 2007/0263036 A1 Nov. 15, 2007

(30) Foreign Application Priority Data

May 11, 2006 (JP) ..... 2006-132785

(51) Int. Cl.
*B41J 2/015* (2006.01)

(52) U.S. Cl. ..... 347/20

(58) Field of Classification Search ..... None
See application file for complete search history.

(56) References Cited

U.S. PATENT DOCUMENTS

2005/0140741 A1 6/2005 Kubo

FOREIGN PATENT DOCUMENTS

JP 2005178306 A 7/2005

*Primary Examiner*—Matthew Luu
*Assistant Examiner*—Justin Seo
(74) *Attorney, Agent, or Firm*—Baker Botts L.L.P.

(57) ABSTRACT

An ink-jet head includes a head main body having a metal portion, an actuator, a power supply member, and a heat sink that makes an outer surface of the ink-jet head. The power supply member includes a base, and a driver IC chip that is mounted on the base and drives the actuator. A first heat-transfer member is positioned between the driver IC chip and the heat sink. A second heat-transfer member is positioned between the base and the metal portion. The first heat-transfer member is in contact with the second heat-transfer member without interposition of the base.

10 Claims, 15 Drawing Sheets

INK-JET HEAD

CROSS-REFERENCE TO RELATED APPLICATIONS

This application claims the benefit the benefit of Japanese Patent Application No. 2006-132785, filed May 11, 2006, the disclosure of which is incorporated herein by reference in its entirety.

BACKGROUND OF THE INVENTION

1. Field of the Invention

The present invention relates to an ink-jet head that ejects ink from a nozzle.

2. Description of the Related Art

An ink-jet head that ejects an ink droplet from a nozzle is sometimes provided with a heat sink that absorbs heat generated in a driver IC chip and releases the heat to outside of the head in order to avoid excessive temperature rise in the driver IC chip that drives an actuator for applying ejection energy to ink. In a recording head disclosed in Japanese Unexamined Patent Publication No. 2005-178306, a flexible wire cable having an IC chip mounted thereon is disposed on an upper face of a piezoelectric actuator, and a surface of the IC chip is in contact with a side wall of a heat sink. Accordingly, heat generated in the IC chip is transmitted to the heat sink and then released from the heat sink to outside of the head.

SUMMARY OF THE INVENTION

In order to downsize the recording head disclosed in the above-mentioned document, the heat sink have to be downsized. In the above-mentioned document, however, heat generated in the driver IC chip is removed by the heat sink alone. Therefore, if the heat sink is downsized, a surface area of the heat sink decreases so that heat generated in the driver IC chip cannot be quickly removed from the driver IC chip. This may cause an excessive temperature rise in the driver IC chip.

The present invention may provide an ink-jet head that hardly causes an excessive temperature rise in a driver IC chip even with a small-size heat sink.

According to an aspect of the present invention, there is provided an ink-jet head including a head main body, an actuator, a power supply member, a heat sink, a first heat-transfer member, and a second heat-transfer member. The head main body includes a metal portion and an ink passage which communicates with a nozzle which ejects an ink droplet. The actuator applies ejection energy to ink contained in the ink passage. The power supply member includes a base, and a driver IC chip which is mounted on the base and drives the actuator. The heat sink makes an outer surface of the ink-jet head, and opposes the driver IC chip. The first heat-transfer member is positioned between the driver IC chip and the heat sink. The second heat-transfer member is positioned between the base and the metal portion. The first heat-transfer member is in contact with the second heat-transfer member without interposition of the base.

According to the aspect, heat generated in the driver IC chip is not only transferred through the first heat-transfer member to the heat sink that makes the outer surface of the head and then released from the heat sink to the outside of the head, but also released through the first and second heat-transfer members to the metal portion of the head main body. Therefore, even when the heat sink is small in size, a temperature of the driver IC chip is hardly excessively increased.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
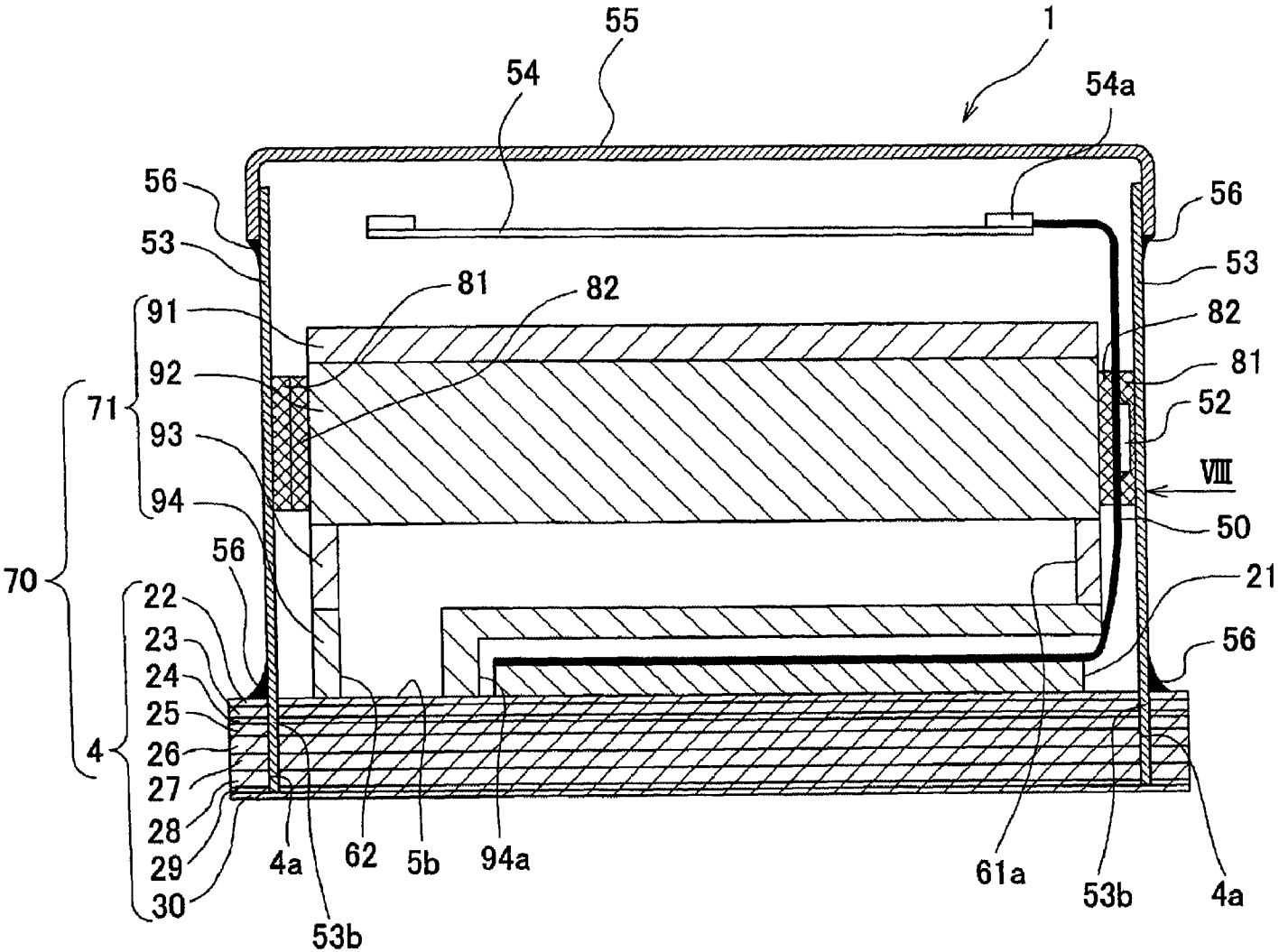
FIG. 1 shows a longitudinal section of an ink-jet head according to an embodiment of the present invention.

An ink-jet head 1 shown in FIG. 1 is, in a functional sense, made up mainly of three components, namely, a head main body 70, a head driver, and a protective casing. The ink-jet head 1 has a rectangular parallelepiped shape elongated in one direction.

The head main body 70 includes a passage unit 4 and a reservoir unit 71. Ink passages are formed inside the head main body 70. The ink passages are involved in temporarily storing, distributing, and ejecting ink that has been supplied from the outside. Ink is ejected from nozzles formed in the passage unit 4, thus forming an image is formed on a record medium. The head driver includes a piezoelectric actuator 21, a substrate 54 having various electronic components mounted thereon, and a Chip On Film (COF) 50 which is a flexible power supply member and electrically connects the piezoelectric actuator 21 and the substrate 54 to each other. A driver IC chip 52 that drives the piezoelectric actuator 21 is mounted on a surface of the COF 50. In the driver IC chip 52, a drive signal is generated based on an image signal supplied from outside. The piezoelectric actuator 21 is driven by the drive signal. When the piezoelectric actuator 21 is driven, ejection energy is applied to ink contained in the passage. The protective casing has two side covers 53 acting as a heat sink, and a head cover 55. The protective casing cooperates with the passage unit 4 to form an enclosed space. The protective casing prevents ink from entering the enclosed space that contains the substrate 54 and the piezoelectric actuator 21, which are electrically operated parts.

Figure 2:
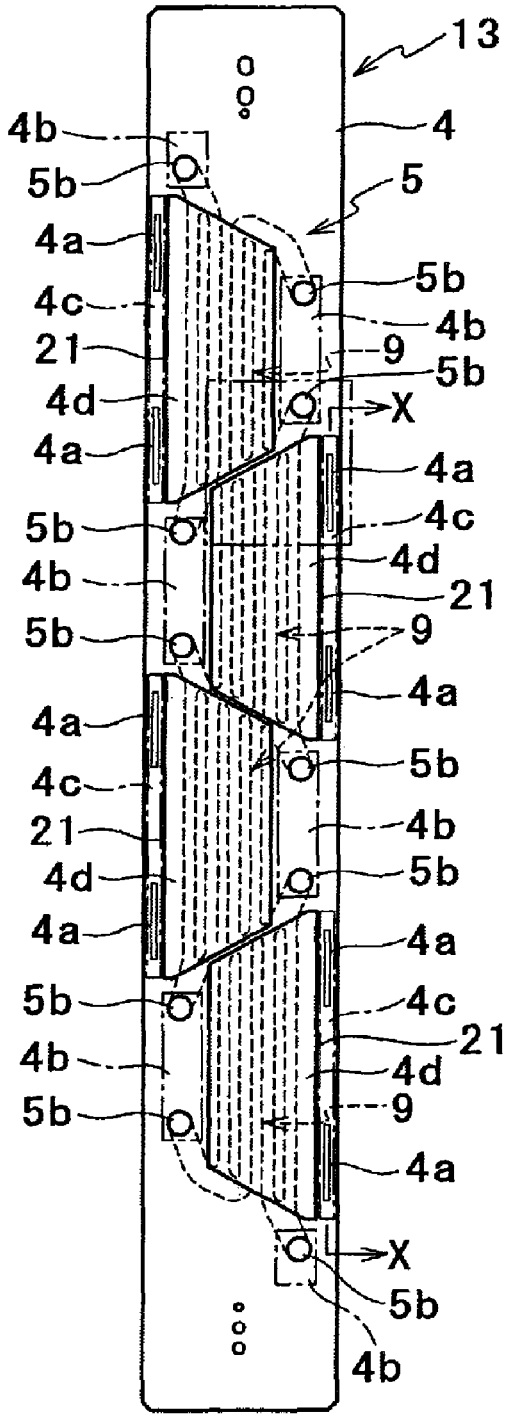
FIG. 2 is a plan view of a passage unit and a piezoelectric actuator of the ink-jet head shown in FIG. 1.
Figure 3:
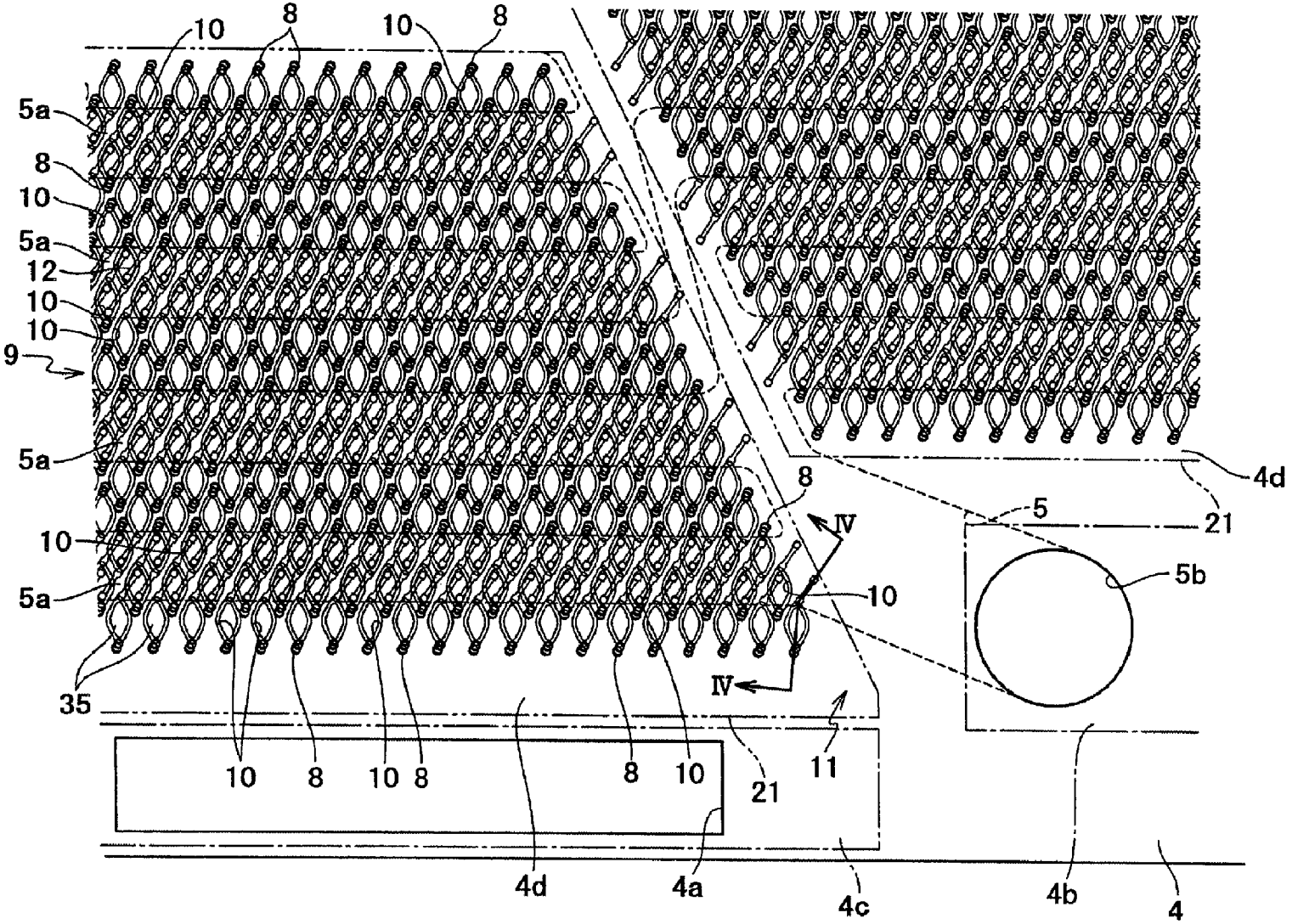
FIG. 3 is an enlarged view of a region that is enclosed by an alternate long and two short dashes line in FIG. 2.
Figure 4:
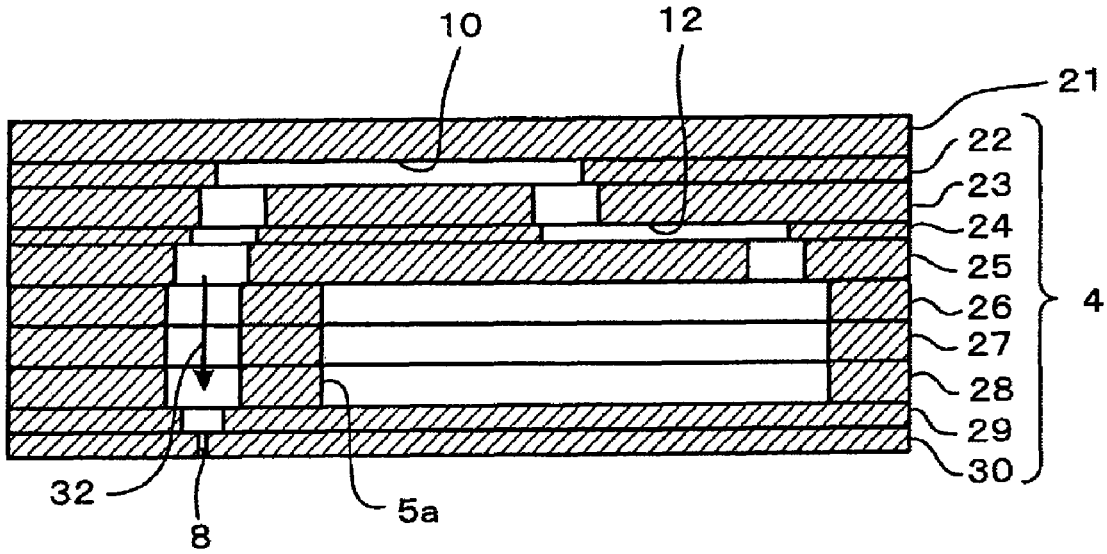
FIG. 4 is a sectional view as taken along line IV-IV in FIG. 3.

The passage unit 4 of the head main body 70 will be described further with reference to FIGS. 2 to 4. In FIG. 3, for the purpose of easy understanding, piezoelectric actuators 21 are illustrated with alternate long and two short dashes lines, while pressure chambers 10, apertures 12, nozzles 8 and the like are illustrated with solid lines through they locate under the piezoelectric actuators 21 and therefore actually should be illustrated with broken lines. In the passage unit 4, ink passages that are involved in distributing and ejecting ink are formed. In a plan view, as shown in FIG. 2, the passage unit 4 has a rectangular shape. As shown in FIG. 4, the passage unit 4 has a layered structure of nine metal plates 22 to 30. The passage unit 4 has, on its upper face, six first regions 4*b*, four second regions 4*c*, and four third regions 4*d*.

The first regions 4*b* are regions where ink supply ports 5*b* are formed, and arranged near longer edges of the passage unit 4. The second regions 4*c* are regions where grooves 4*a* for insertion of the side covers 53 are formed. Like the first regions 4*b*, the second regions 4*c* are arranged near the longer edges of the passage unit 4. The third regions 4*d* are trapezoidal regions to which the piezoelectric actuators 21 are bonded. The third regions 4*d* are arranged in two rows in a zigzag pattern along a lengthwise direction of the passage unit 4. In regions inside the passage unit 4 corresponding to the third regions 4*d*, a plurality of pressure chambers 10 are provided to form pressure chamber groups 9 as shown in FIG. 3. On a lower face of the passage unit 4 opposed to the third regions 4*d* defined on the upper face of the passage unit 4, a plurality of ejection ports for nozzles 8 communicating with the respective pressure chamber 10 are provided to form an ink ejection region 11.

The reservoir unit 71 of the head main body 70 will be briefly described with reference to FIG. 5 and FIGS. 6A to 6D. In the reservoir unit 71, ink passages that are involved in temporarily storing ink are formed. The reservoir unit 71 is fixed to the upper face of the passage unit 4. A filter 47, a hole 61. And the like are formed inside the reservoir unit 71. The filter 47 filters ink, and the hole 61 acts as an ink storage. The reservoir unit 71 has a layered structure of four plates 91 to 94.

Figure 7:
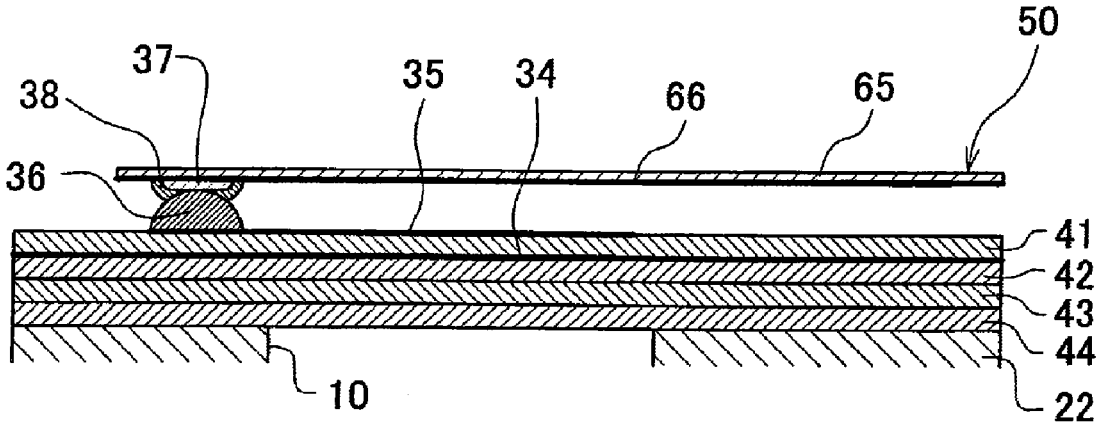
FIG. 7 is a partial enlarged view of FIG. 4, showing a vicinity of the piezoelectric actuator.

The head driver will be briefly described with reference to FIG. 7. The piezoelectric actuator 21 applies, as ejection energy, pressure to ink contained in a pressure chamber 10, so that an ink droplet is ejected from a corresponding nozzle 8. The piezoelectric actuator 21 is disposed in a gap between the passage unit 4 and the reservoir unit 71, and fixed to the third region 4*d* of the passage unit 4. As shown in FIG. 7, the piezoelectric actuator 21 has a layered structure of four piezoelectric layers 41 to 44.

The COF 50, which electrically connects the piezoelectric actuator 21 to the substrate 54, supplies a drive signal to the piezoelectric actuator 21. The COF 50 includes a base 65 and a plurality of wires 66. The base 65 is made of an insulating resin plate having flexibility. The plurality of wires 66 are formed on one surface of the base 65. One end portion of the COF 50 is bonded to an upper face of the piezoelectric actuator 21. The wires 66 are electrically connected to respective individual electrode 35. The wires 66 are connected to a common electrode 34, though not shown. On one surface of the base 65, a driver IC chip is mounted at a substantially central portion. The driver IC chip is able to control potentials of the individual electrodes 35 and the common electrode 34, as will be described later. One end of the COF 50 extends upward in a space between the side cover 53 and the reservoir unit 71. The other end of the COF 50 is connected to a connector 54*a* that is attached on the substrate 54. In accordance with, an image signal supplied from outside, the various electronic components mounted on the substrate 54 generate a signal which will be, supplied to the driver IC chip 52.

The protective casing will be briefly described. A thermal conductivity of the side covers 53 is higher than that of the base 65 of the COF 50. The side cover 53 is a rigid plate made of a metal material. As shown in FIG. 1, the side covers 53 stand near both widthwise ends of the passage unit 4. A head cover 55 is a rigid member made of a metal material. The head cover 55 covers the two side covers 53 from above, and bends downward in the vicinity of both lengthwise ends in the ink-jet head 1 so as to come into contact with the upper face of the passage unit 4. As shown in FIG. 1, the piezoelectric actuator 21, the COF 50, the substrate 54, and the reservoir unit 71 are accommodated within the enclosed space defined by the protective casing and the passage unit 4.

Next, the passage unit 4 will be described in more detail. As shown in FIGS. 2 and 3, the three regions of the first regions 4*b*, the second regions 4*c*, and the third regions 4*d*, which have a specific positional relation with each other as described above, are formed on the upper face of the passage unit 4. There are six first regions 4*b* in which the ink supply ports 5*b* are formed. In each of the two first regions 4*b* located at both lengthwise ends, a single ink supply port 5*b* is formed. In each of the rest four first regions 4*b* located inside, two ink supply ports 5*b* are formed. The second regions 4*c* in which the grooves 4*a* are formed are disposed corresponding to the four first regions 4*b* located inside. There are four third regions 4*d* each containing the pressure chamber group 9. In each of the third regions 4*d*, all pressure chambers 10 are covered with the piezoelectric actuator 21. On a lower face of the passage unit 4, regions opposed to the third regions 4*d* serve as ink ejection regions 11. As shown in FIG. 3, a plurality of ejection ports for nozzles 8 are regularly arranged on a surface of the ink ejection regions 11.

The pressure chambers 10 in each pressure chamber group 9 are opposite to the respective individual electrodes 35 that are formed in the piezoelectric actuator 21. The plurality of pressure chambers 10 are regularly arranged in a matrix. With respect to a widthwise direction, there are sixteen rows of pressure chambers 10 extending in parallel to each other. Each of the rows is made up of pressure chambers 10 arranged at regular intervals in the lengthwise direction. The number of pressure chambers 10 included in each row gradually decreases from a longer side to a shorter side of the piezoelectric actuator 21, in conformity with an outer shape of the piezoelectric actuator 21.

Both of the first regions 4*b* and the second regions 4*c* are arranged in the lengthwise direction in a zigzag pattern across the third regions 4*d*. The ink supply ports 5*b* and the grooves 4*a* are positioned opposite to each other with respect to the widthwise direction. With respect to the widthwise direction, further, the groove 4*a*, a side face of the reservoir unit 71, and the ink supply port 5*b* are arranged in this order from one widthwise end of the passage unit 4, as shown in FIG. 1. Since there is a little interval between the groove 4*a* and the side face of the reservoir unit 71, the COF 50 extends upward through the interval between the side cover 53 and the reservoir unit 71, as will be described later. The groove 4*a* and the ink supply port 5*b* do not align with each other with respect to the lengthwise direction. Therefore, decrease in rigidity of the passage unit 4 can be suppressed.

As shown in FIG. 3, manifold channels 5 and sub manifold channels 5*a* are formed inside the passage unit 4. The manifold channels 5 act as a common ink chamber, and the sub manifold channels 5*a* are branch passages of the manifold channels 5. The manifold channel 5 extends along an oblique side of the piezoelectric actuator 21, and disposed across the lengthwise direction of the passage unit 4. In a middle portion of the passage unit 4, adjacent pressure chamber groups 9 share one manifold channel 5, and sub manifold channels 5*a* are branched from both sides of the manifold channel 5. Each of the ink ejection regions 11 is opposed to four sub manifold channels 5*a* extending in the lengthwise direction of the passage unit 4. Through the ink supply port 5*b* formed on the upper face of the passage unit 4, ink is supplied to the manifold channel 5 and distributed to the respective ink passages.

As shown in FIG. 4, each of the nozzles 8 communicates with a sub manifold channel 5*a* through a pressure chamber 10 having a substantially rhombic shape in a plan view and an aperture 12 acting as a throttle, as shown in FIG. 4. Formed inside the passage unit 4 are individual ink passages 32 each extending from an outlet of the sub manifold channel 5*a* through a pressure chamber 10 to a corresponding nozzle 8. The nozzles 8 are, like the pressure chambers 10, arranged in a matrix, though they keep away from the sub manifold channels 5*a* that are formed inside the passage unit 4. In addition, like the pressure chambers 10, the nozzles 8 form sixteen nozzle rows. Every four rows share one sub manifold channel 5*a*. All the nozzles 8 included in these four rows communicate with the one sub manifold channel 5*a* they share.

Assuming that an imaginary line extends in the lengthwise direction of the passage unit 4, the nozzles 8 are positioned in such a manner that, when all of them are projected onto the imaginary line in a direction perpendicular to the imaginary line, their projective points on the imaginary line can be arranged at an interval corresponding to an image resolution.

A cross-sectional structure of the passage unit 4 will be described with reference to FIGS. 1 and 4. As shown in FIGS. 1 and 4, the passage unit 4 has a layered structure of, from the top, a cavity plate 22, a base plate 23, an aperture plate 24, a supply plate 25, manifold plates 26, 27, 28, a cover plate 29, and a nozzle plate 30.

The cavity plate 22 is a metal plate in which formed are a plurality of substantially rhombic holes serving as pressure chambers 10, and eight through holes serving as a part of the grooves 4*a*. The base plate 23 is a metal plate in which formed are a plurality of connection holes each connecting each pressure chamber 10 to a corresponding aperture 12, a plurality of connection holes each connecting each pressure chamber 10 to a corresponding nozzle 8, and eight through holes serving as a part of the grooves 4*a*. The aperture plate 24 is a metal plate in which formed are holes serving as apertures 12, a plurality of connection holes each connecting each pressure chamber 10 to a corresponding nozzle 8, and eight through holes serving as a part of the grooves 4*a*. The supply plate 25 is a metal plate in which formed are a plurality of connection holes each connecting each aperture 12 to a sub manifold channel 5*a*, a plurality of connection holes each connecting each pressure chamber 10 to a corresponding nozzle 8, and eight through holes serving as a part of the grooves 4*a*. Each of the manifold plates 26, 27, and 28 is a metal plate in which formed are holes constituting sub-manifold channels 5*a*, a plurality of connection holes each connecting each pressure chamber 10 to a corresponding nozzle 8, and eight through holes serving as a part of the grooves 4*a*. The cover plate 29 is a metal plate in which formed are a plurality of connection holes each connecting each pressure chamber 10 to a corresponding nozzle 8, and eight through holes serving as a part of the grooves 4*a*. The nozzle plate 30 is a metal plate in which formed are a plurality of nozzles 8.

As described above, the respective plates 22 to 30 constituting the passage unit 4 have a group of ink passage holes, which includes the hole and the through holes that constitute the ink passages, and a group of groove holes, which includes the through holes that constitute the grooves 4*a*. In addition, the base plate 23 to the supply plate 25 have a group of supply port holes which includes the through holes connecting the ink supply ports 5*b* formed in the cavity plate 22 to the manifold channels 5. In the passage unit 4, the group of groove holes, the group of ink passage holes, and the group of supply port holes are formed at intervals in this order with respect to the widthwise direction. The group of ink passage holes is sandwiched between the group of groove holes and the group of supply port holes.

The nine metal plates are positioned in layers so as to form individual ink passages 32. At this time, the through holes formed in the eight plates 22 to 29 and serving as a part of the grooves 4*a* overlap with each other in a plan view, so that these through holes cooperate with an upper face of the nozzle plate 30 to form the grooves 4*a*. Since, like this, the grooves 4*a* are made by forming the through holes in the eight plates 22 to 29 other than the nozzle plate 30, the grooves 4*a* do no reach a lower face of the nozzle plate 30. This allows the grooves 4*a* to be as deep as possible while preventing ink adhering to the lower face of the nozzle plate 30 from flowing through the groove 4*a* onto the upper face of the passage unit 4.

Ink supplied through the ink supply port 5*b* flows through the manifold channel 5 into the sub manifold channels 5*a*. At exits of the sub manifold channels 5*a*, the ink is distributed to the respective individual ink passages 32 and then reaches the respective nozzles 8.

Figure 5:
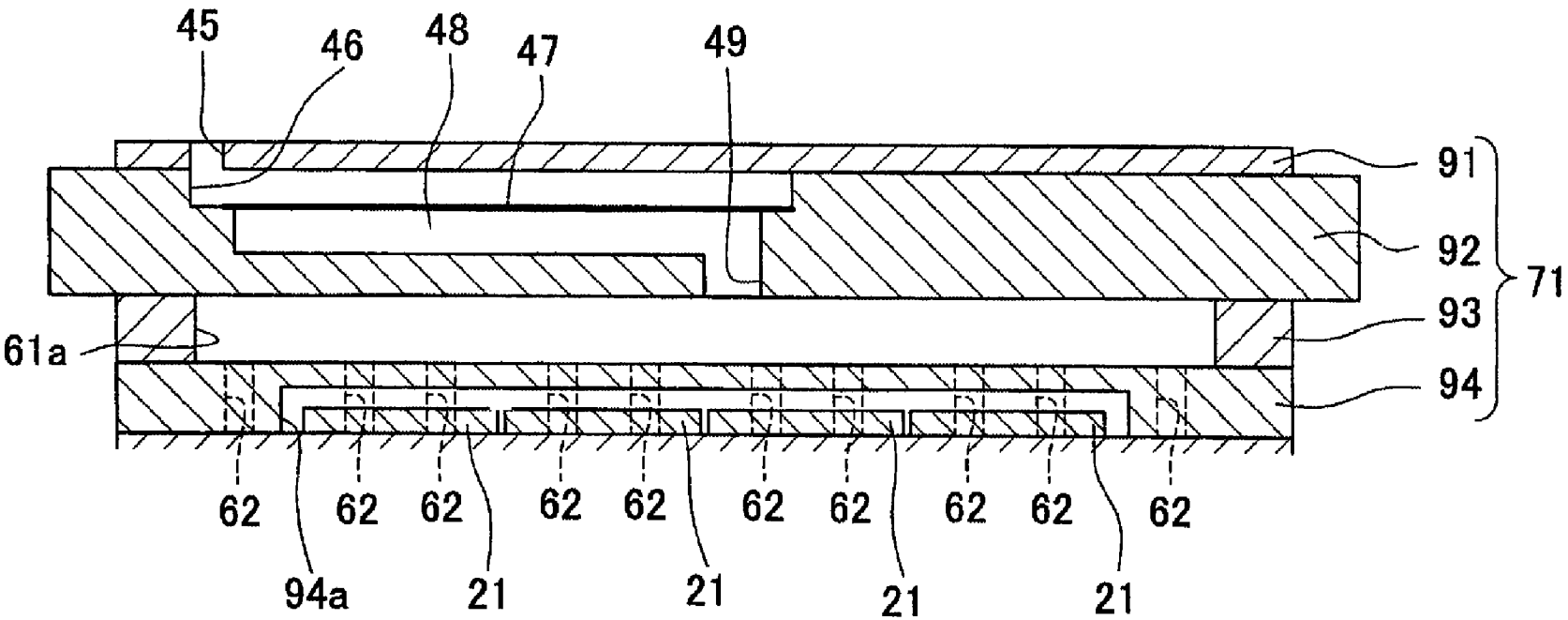
FIG. 5 shows a longitudinal section of a reservoir unit that is included in the ink-jet head shown in FIG. 1, as taken along a longer direction of the reservoir unit.

Next, the reservoir unit 71 will be described. As shown in FIG. 5, the reservoir unit 71 has, from a top, four plates of an upper plate 91, a filter plate 92, a reservoir plate 93, and an under plate 94 positioned to and laminated with one another. Each of the four plates 91 to 94 is a flat plate made of a metal material and having a substantially rectangular shape whose lengthwise direction is the same as the lengthwise direction of the passage unit 4. As shown in FIG. 1, a width of the four plates 91 to 94 is shorter than an interval between the two side covers 53. The filter plate 92, which is longer than the other three plates 91, 93, and 94, functions as a support member in mounting the ink-jet head 1 to a printer main body.

Figure 6A:
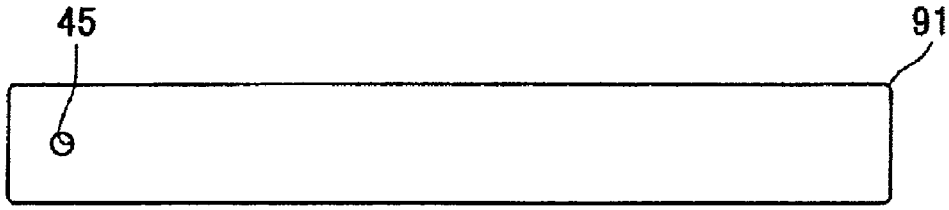
FIGS. 6A to 6D are plan views of four plates that constitute the reservoir unit shown in FIG. 5.

As shown in FIGS. 5 and 6A, a hole 45 is formed in the upper plate 91. The hole 45 is provided near one longitudinal end (lefthand in FIG. 5) of the upper plate 91. Ink is supplied from a not-shown ink tank into the hole 45.

Figure 6B:
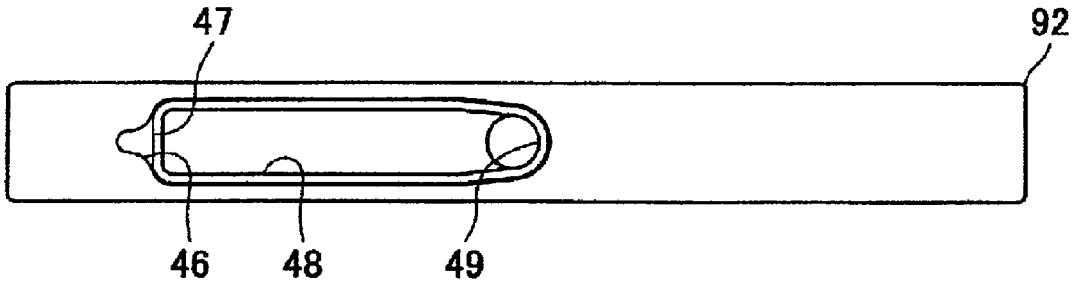

As shown in FIGS. 5 and 6B, the filter plate 92 has a recess 46 extending downward from an upper face of the filter plate 92. A depth of the recess 46 is approximately one third a thickness of the filter plate 92. At a portion opposed to the hole 45, the recess 46 communicates with the hole 45. The recess 46 extends in a lengthwise direction of the filter plate 92, to a substantially central portion of the filter plate 92. On a bottom face of the recess 46, a filter 47 is disposed over an entire area.

In a filter plate 92, a recess 48 having a depth of approximately one third the thickness of the filter plate 92 is formed under the recess 46 with sandwiching the filter 47 therebetween. In a plan view, the recess 48 is slightly smaller in size than the recess 46. A hole 49 is formed in a bottom face of the recess 48, at an end of the bottom face opposite to the hole 45 with respect to the lengthwise direction. A depth of the hole 49 is approximately one third the thickness of the filter plate 92, and its opening appears on a lower face of the filter plate 92. Through the hole 49, the recess 48 communicates with a later-described hole 61.

Figure 6C:
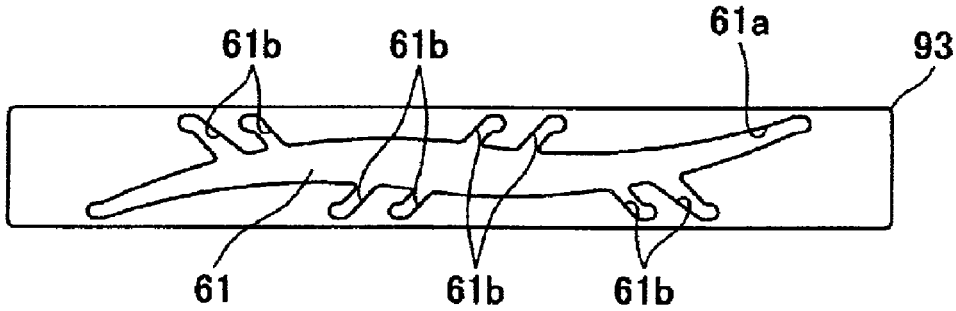

As shown in FIGS. 5 and 6C, the hole 61 is formed in the reservoir plate 93. The hole 61 is made up of a main passage 61*a* and eight branch passages 61*b*. The main passage 61*a* extends in a middle portion of the reservoir plate 93 in the lengthwise direction. The eight branch passages 61*b* branch out from midpoints of the main passage 61*a*. One end (left-hand in FIG. 6C) of the main passage 61*a* curves downward in FIG. 6C, and the other end (righthand in FIG. 6C) curves upward in FIG. 6C. Each of the main passage 61*a* and the branch passages 61*b* has its end terminated corresponding to each ink supply port 5*b* of the passage unit 4. Here, the hole 61 functions as an ink reservoir that stores ink therein.

Figure 6D:
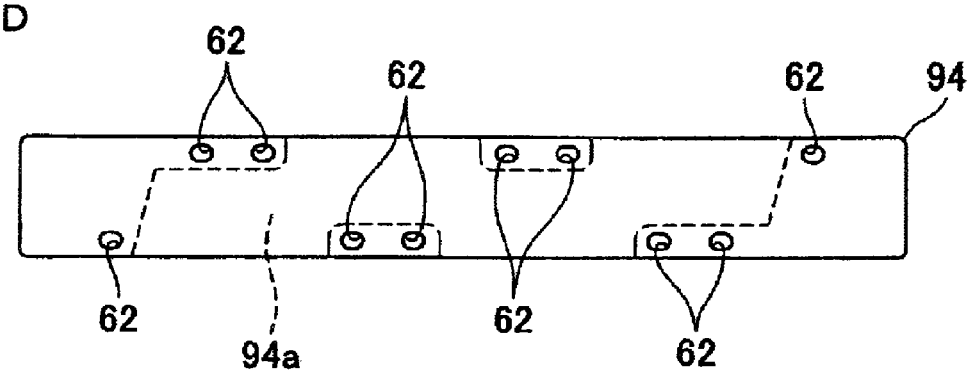

As shown in FIGS. 5 and 6D, ten holes 62 having a substantially circular shape in a plan view are formed in the under plate 94. The ten holes 62 communicate with the ends of the respective branch passages 61*b*. The holes 62 are formed near both widthwise ends of the under plate 94, so as to correspond to the ink supply ports 5*b* of the passage unit 4. Also, a lower face of the under plate 94 is, in its region except surrounding both lengthwise ends and surrounding the holes 62, reduced in thickness as compared with such surrounding portions, so that a recess 94*a* is formed on the lower face of the under plate 94. At a region other than the recess 94*a*, the reservoir unit 71 is fixed to the passage unit 4. Here, in the region where the recess 94*a* is formed, a gap appears between the upper face of the passage unit 4 and the under plate 94. In the gap, the piezoelectric actuator 21 is bonded to a surface of the passage unit 4 with a narrow gap being formed between the piezoelectric actuator 21 and the under plate 94, as shown in FIG. 1.

In the reservoir unit 71, the hole 45 communicates with the holes 62 through the recess 46, the recess 48, the hole 49, and the hole 61. Ink supplied from an ink tank to the hole 45 is cleared by the filter 47 on the way to the hole 49. Then, the ink flows into the hole 61 where the ink is temporarily stored. Correspondingly to consumption of ink in the passage unit 4, the ink stored in the hole 61 is supplied through the holes 62 and the ink supply ports 5*b* to the passage unit 4.

Next, the head driver will be described in more detail with reference to FIGS. 7 to 9. As described above, the piezoelectric actuator 21, which is a layered structure having trapezoidal shape in a plan view, is fixed to the cavity plate 22. As shown in FIG. 2, each piezoelectric actuator 21 is disposed with its parallel opposed sides, which mean upper and lower sides, extending along the lengthwise direction of the passage unit 4. Oblique sides of every neighboring piezoelectric actuators 21 overlap each other with respect to the lengthwise direction.

Each of the piezoelectric layers 41 to 44 included in the layered structure is a flat plate (continuous flat layers) having a thickness of approximately 15 μm. The piezoelectric layers 41 to 44 are sequentially put in layers, to form the piezoelectric actuator 21 having a thickness of approximately 60 μm. In the piezoelectric actuator 21, an actuator as a unit structure as shown in FIG. 7 is built for every pressure chamber 10. The piezoelectric actuator 21 is an aggregation of a plurality of actuators. The piezoelectric actuator 21 extends over all pressure chambers 10 included in the pressure chamber group 9. The piezoelectric actuator 21 is able to selectively change an internal volume of a pressure chamber 10 corresponding to each actuator. The respective piezoelectric layers 41 to 44 are made of a lead zirconate titanate (PZT)-base ceramic material having ferroelectricity.

As shown in FIG. 7, an individual electrode 35 having a thickness of approximately 1 μm is formed on the uppermost piezoelectric layer 41. Both of the individual electrode 35 and a later-described common electrode 34 are made of a conductive material such as a metal. As shown in FIG. 3, the individual electrode 35 has a substantially rhombic shape in a plan view. The individual electrode 35 is formed so that it is opposed to a pressure chamber 10 and at the same time its large part falls within the pressure chamber 10 in a plan view. Thus, substantially over a whole area on the uppermost piezoelectric layer 41, a plurality of individual electrodes 35 are regularly arranged in two dimensions, as shown in FIG. 3. A portion of the piezoelectric layer 41 sandwiched between the individual electrode 35 and the common electrode 34 works as an active layer which is displaced due to application of an external electric field, and a portion of the piezoelectric actuator 21 opposed to the individual electrode 35 works as an individual actuator. Since the individual electrodes 35 are formed only on a surface of the piezoelectric actuator 21, only the outermost piezoelectric layer 41 includes active regions. As a result, the piezoelectric actuator 21 is made up of actuators that present unimorph-type deformation, and therefore can be deformed at good efficiency.

One acute portion of the individual electrode 35 extends out to a position above a pillar portion of the cavity plate 22 which means a portion of the cavity plate 22 defining a pressure chamber 10 and supportingly bonded to the piezoelectric actuator 21. A land 36 is provided on the vicinity of an end of this extending-out portion. The land 36 has a substantially circular shape in a plan view, and has a thickness of approximately 15 μm. The land 36 is made of a conductive material similar to that of the individual electrode 35 and the common electrode 34. The individual electrode 35 and the land 36 are electrically connected to each other.

A common electrode 34 having a thickness of approximately 2 μm is interposed between the uppermost piezoelectric layer 41 and the piezoelectric layer 42 disposed under the uppermost piezoelectric layer 41. The common electrode 34 is formed over an entire face of the sheet. As a result, the piezoelectric layer 41 is, in its portion opposed to the pressure chamber 10, sandwiched between a pair of the individual electrode 35 and the common electrode 34.

Each of the plurality of individual electrodes 35 is electrically connected to the driver IC chip 52 individually through a wire 66 of the COF 50, as will be described later. Thus, the driver IC chip 52 controls a potential of each individual electrode 35. The common electrode 34 is electrically connected to unillustrated surface electrodes through holes formed through the piezoelectric layer 41. The surface electrodes are formed at four corners on the surface of the piezoelectric actuator 21. The surface electrodes are grounded. Consequently, the common electrode 34 is, in its regions corresponding to all the pressure chambers 10, equally kept at the ground potential.

As shown in FIG. 7, the COF 50 is disposed above the piezoelectric actuator 21. The COF 50 is made up of a sheet-like base 65 on one surface (i.e., a lower face in FIG. 7) of which bumps 37, the driver IC chip 52, wires 66 and the like are placed. The bump 37 is disposed near one end of the wire 66 so as to correspond to the land 36. A lower face of the bump 37 is covered with a solder 38. The solder 38 electrically connects the bump 37 to the land 36, and at the same time fix the COF 50 to the piezoelectric actuator 21. The bump 37 is electrically connected to the driver IC chip 52 through the wire 66, so that the driver IC chip 52 controls a potential of the individual electrode 35.

Figure 8:
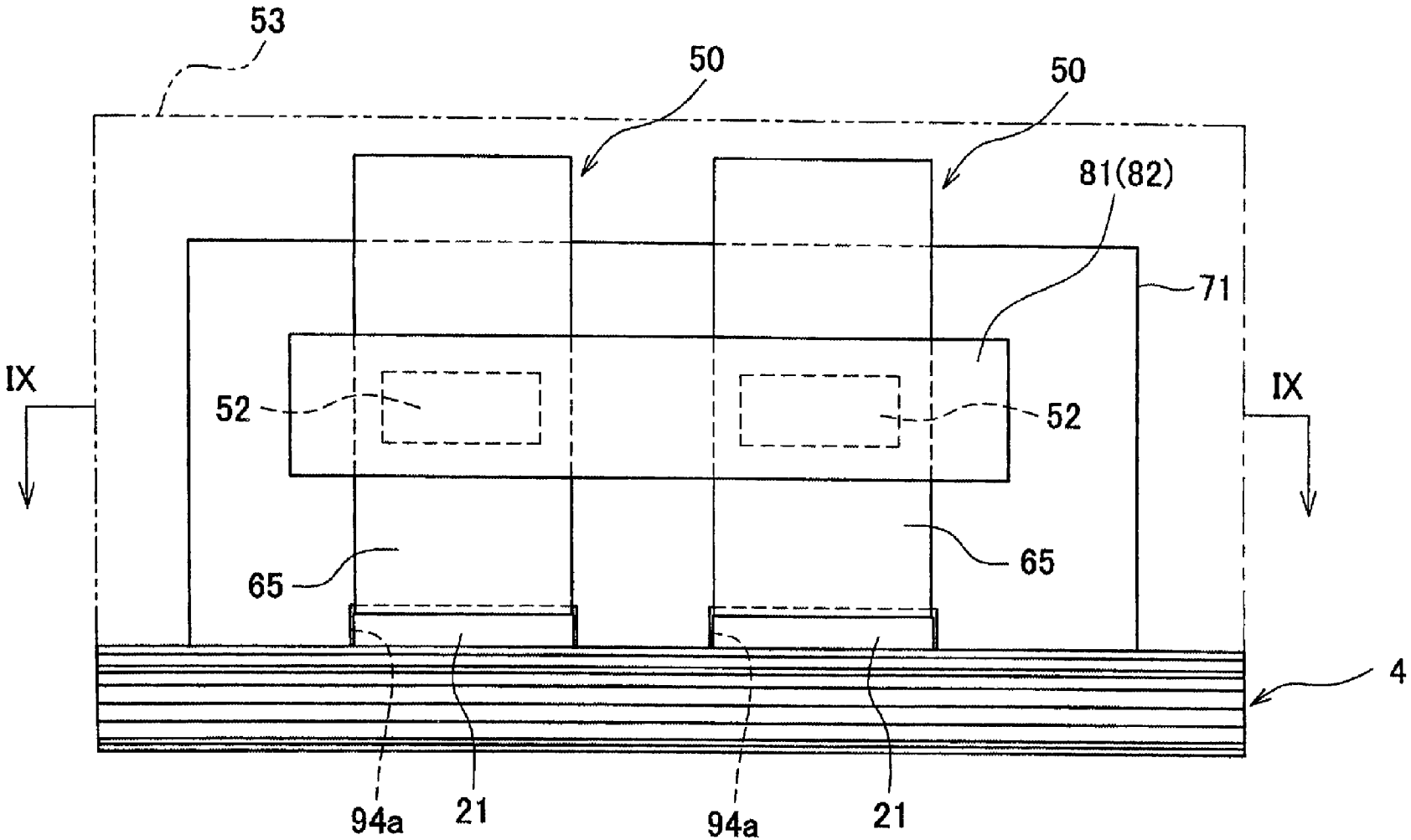
FIG. 8 is a side view of the ink-jet head as seen in a direction indicated by a reference sign VIII in FIG. 1.

As shown in FIGS. 1 and 8, at a vicinity of one end (right-hand in FIG. 1) of the upper face of the piezoelectric actuator 21, the COF 50 extends upward through a space between the reservoir unit 71 and the side cover 53. The driver IC chip 52 is mounted to a portion of the COF 50 sandwiched between the reservoir unit 71 and the side cover 53, so that the driver IC chip 52 is opposed to the side cover 53. In this embodiment, the driver IC chip 52 is opposed to the filter plate 92 of the reservoir unit 71.

A heat-transfer sheet 81 which is a first heat-transfer member is disposed between the COF 50 and the side cover 53, at a position opposed to the driver IC chip 52 and therearound. A thermal conductivity of the heat-transfer sheet 81 is higher than that of the base 65. The heat-transfer sheet 81 is made of a flexible material having a low hardness, such as carbon, rubber, composite materials thereof, a low-hardness gel material, or acryl-base material. A thickness of the heat-transfer sheet 81 is larger than those of the driver IC chip 52 and the base 65. The heat-transfer sheet 81 is in close contact with an outer face of the driver IC chip 52 and an inner face of the side cover 53. As a result, heat generated in the driver IC chip 52 is transferred through the heat-transfer sheet 81 to the side cover 53, and then released from the metal-made side cover 53 to outside of the head.

A heat-transfer sheet 82 which is a second heat-transfer member is disposed between the COF 50 and the reservoir unit 71, at a position opposed to the driver IC chip 52 and therearound. The heat-transfer sheet 82 has the same dimensions as that of the heat-transfer sheet 81. The heat-transfer sheet 82 is made of the same material as that of the heat-transfer sheet 81, and thus has a thermal conductivity higher than that of the base 65. A thickness of the heat-transfer sheet 82 is larger than those of the driver IC chip 52 and the base 65. The heat-transfer sheet 82 is in close contact with an inner face of the base 65 and a side face of the filter plate 92 which is a metal portion.

A length of the heat-transfer sheets 81 and 82 with respect to a horizontal direction in FIG. 8 is greater than twice a width of the COF 50 (which means twice a length of the COF 50 with respect to the horizontal direction in FIG. 8) plus a distance between the two COFs 50. Consequently, the heat-transfer sheets 81 and 82 are disposed over two neighboring COFs 50. The heat-transfer sheet 81 and the heat-transfer sheet 82 adhere to each other at three regions outside the COFs 50 without interposition of the base 65. The three regions mean a region between the two COFs 50, a region near one end of the heat-transfer sheets 81 and 82, and a region near the other end of the heat-transfer sheets 81 and 82. Accordingly, heat transferred from the driver IC chip 52 to the heat-transfer sheet 81 is quickly transferred to the heat-transfer sheet 82 through the three adherence regions. The heat is further transferred from the heat-transfer sheet 82 to the filter plate 92 made of a metal and having a thermal conductivity higher than that of the base 65. The heat thus transferred to the filter plate is absorbed by ink that is flowing through the ink passage in the reservoir unit 71, and also absorbed by members around the filter plate 92 and air existing within the enclosed space. Those having absorbed the heat rise in temperature. The ink having absorbed the heat is ejected from the nozzles, and at the same time the heat is emitted from an outer surface of the head to outside. Therefore, a temperature of the head 1 which includes the filter plate 92 is not excessively increased by the heat transferred from the heat-transfer sheet 82.

In this embodiment, heat generated in the driver IC chip 52 is released through the heat-transfer sheet 81 and the side cover 53 to the outside of the head 1, and in addition the heat is transferred through the heat-transfer sheets 81 and 82 to the filter plate 92 which is a part of the head main body 70. That is, heat of the driver IC chip 52 is absorbed from the driver IC chip 52 through two routes. Therefore, even when the side cover 53 which functions as a heat sink is a small-size one, a temperature of the driver IC chip 52 is not excessively increased.

Both of the heat-transfer sheets 81 and 82 extend beyond an outer periphery of the base 65, and the heat-transfer sheet 81 adheres to the heat-transfer sheet 82 at portions beyond the outer periphery of the base 65. This makes it easier to increase an adherence area, as compared with when the two heat-transfer sheets 81 and 82 adhere to each other at a through hole formed in the base 65. Therefore, heat can be efficiently absorbed from the driver IC chip 52.

Since the length of the heat-transfer sheets 81 and 82 is greater than a width of the base 65, the heat-transfer sheets 81 and 82 can adhere to each other at respective regions beyond right and left peripheries of the base 65. Therefore, heat can be more efficiently absorbed from the driver IC chip 52.

Since a vertical width of the heat-transfer sheets 81 and 82 is greater than that of the driver IC chip 52, the driver IC chip 52 is contained within a layered structure of the heat-transfer sheets 81 and 82. As a result, heat emitted from the driver IC chip 52 to outside thereof is substantially fully transferred to the side cover 53 or the filter plate 92. In addition, since the heat-transfer sheets 81 and 82 extend over the two COFs 50, the heat-transfer sheets 81 and 82 have a length greater than when they are provided one by one for each driver IC chip 52. This increases all of adherence areas between the heat-transfer sheet 81 and the side cover 53, between the heat-transfer sheet 81 and the heat-transfer sheet 82, and between the heat-transfer sheet 82 and the filter plate 92. Consequently, heat can be further efficiently transferred from the driver IC chip 52 to the side cover 53 and the filter plate 92.

Figure 9:
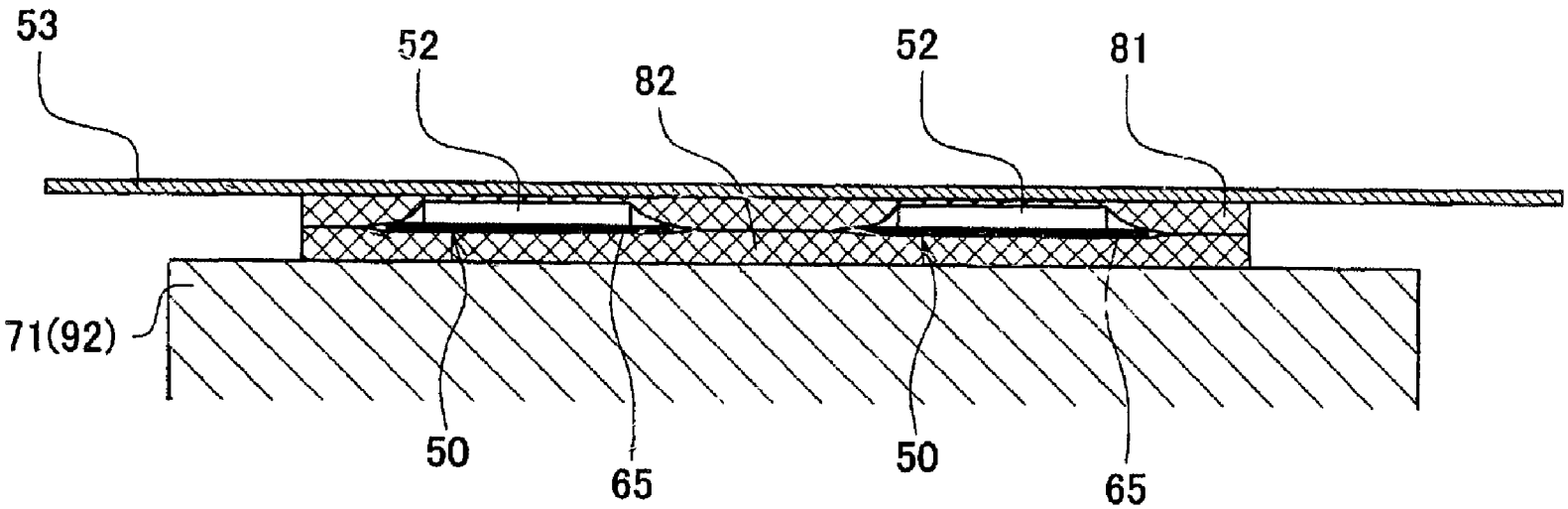
FIG. 9 is a partial sectional view of the ink-jet head as taken along line IX-IX in FIG. 8.

Since each of the heat-transfer sheets 81 and 82 has a thickness larger than those of the driver IC chip 52 and the base 65, an entire area of an outer face of the heat-transfer sheet 81 adheres to the side cover 53 as shown in FIG. 9. That is, the outer face of the heat-transfer sheet 81 adheres to the side cover 53, not only in its region opposed to the driver IC chip 52 but also in its region other than the region opposed to the driver IC chip 52. Also, an entire area of an inner face of the heat-transfer sheet 82 adheres to the filter plate 92. Like this, adherence areas between the heat-transfer sheet 81 and the heat-transfer sheet 82, between the heat-transfer sheet 81 and the side cover 53, and between the heat-transfer sheet 82 and the filter plate 92 are increased furthermore.

In addition, since a thermal conductivity of the side cover 53 functioning as a heat sink is higher than that of the base 65, the side cover 53 quickly receives heat from the heat-transfer sheet 81 and emits the heat to the outside of the head 1. Therefore, heat can be quickly absorbed from the driver IC chip 52.

As apparent from FIGS. 1 and 9, the heat-transfer sheet 81 adheres to the side cover 53 functioning as a heat sink, in its regions both opposed and not opposed to the driver IC chip 52. Accordingly, heat absorbed from the driver IC chip 52 by the side cover 53 can be efficiently released to outside of the head.

Moreover, since a space between the side cover 53 and the filter plate 92 is substantially filled up with the heat-transfer sheets 81 and 82, adherence between the heat-transfer sheet 81 and the side cover 53, between the heat-transfer sheet 82 and the filter plate 92, and between the heat-transfer sheet 81 and the heat-transfer sheet 82 is increased. This makes heat transfer further easier.

Further, the heat-transfer sheets 81 and 82 have flexibility and low hardness. Therefore, even if external force is applied from outside of the side cover 53 toward the driver IC chip 52, the external force can be relieved. Thus, not only dissipation of internal heat but also shock resistance against external force are provided.

Next, an operation of the piezoelectric actuator 21 will be described. In the piezoelectric actuator 21, only the piezoelectric layer 41 among the four piezoelectric layers 41 to 44 is polarized in a direction oriented from the individual electrode 35 toward the common electrode 34. When a predetermined potential is given to an individual electrode 35 by means of the driver IC chip 52, a potential difference occurs in an active region of the piezoelectric layer 41 which means a region thereof sandwiched between the individual electrode 35 thus given the potential and the common electrode 34 kept at the ground potential Consequently, an electric field in a thickness direction occurs in the active region and, due to a transversal piezoelectric effect, the active region of the piezoelectric layer 41 contracts in a horizontal direction which is perpendicular to the polarization direction. No electric field is applied to the other piezoelectric layers 42 to 44 which therefore do not contract in this way. As a result, in the piezoelectric layers 41 to 44, the active region and a portion opposed to the active region as a whole present a unimorph deformation protruding toward a pressure chamber 10. A volume of the pressure chamber 10 is reduced accordingly, to raise ink pressure, so that ink is ejected from a nozzle 8 shown in FIG. 3. Then, when the individual electrode 35 returns to the ground potential, the piezoelectric layers 41 to 44 restore their original shape and thus the pressure chamber 10 restores its original volume. Accordingly, ink is sucked from a sub manifold channel 5*a* into an individual ink passage 32.

In another possible driving mode, a predetermined potential is given to an individual electrode 35 beforehand. Upon every ejection request, the individual electrode 35 is once set at the ground potential and then given the predetermined potential again at a predetermined timing. In this mode, at a timing of setting the individual electrode 35 at the ground potential, the piezoelectric layers 41 to 44 return to their original state and a volume of a pressure chamber 10 becomes larger than in an initial state where a predetermined voltage is applied beforehand. Therefore, ink is sucked from a sub manifold channel 5*a* into the pressure chamber 10. Then, at a timing of giving the predetermined potential to the individual electrode 35 again, portions of the piezoelectric layers 41 to 44 opposed to an active region deform protrudingly toward the pressure chamber 10. The volume of the pressure chamber 10 is accordingly reduced to raise ink pressure, so that an ink droplet is ejected from a nozzle 8.

By repeating ink ejection as described above, charging and discharging current which will be supplied to each actuator flows in the driver IC chip 52. At this time, the driver IC chip 52 generates heat due to effective internal resistance. In this embodiment, however, heat of the driver IC chip 52 is absorbed from the driver IC chip 52 through two routes as described above. Therefore, even when the side cover 53 which functions as a heat sink is a small-size one, a temperature of the driver IC chip 52 is not excessively increased. Therefore, malfunction of the driver IC chip 52 or thermal damage to the driver IC chip 52 can be prevented.

Figure 10:
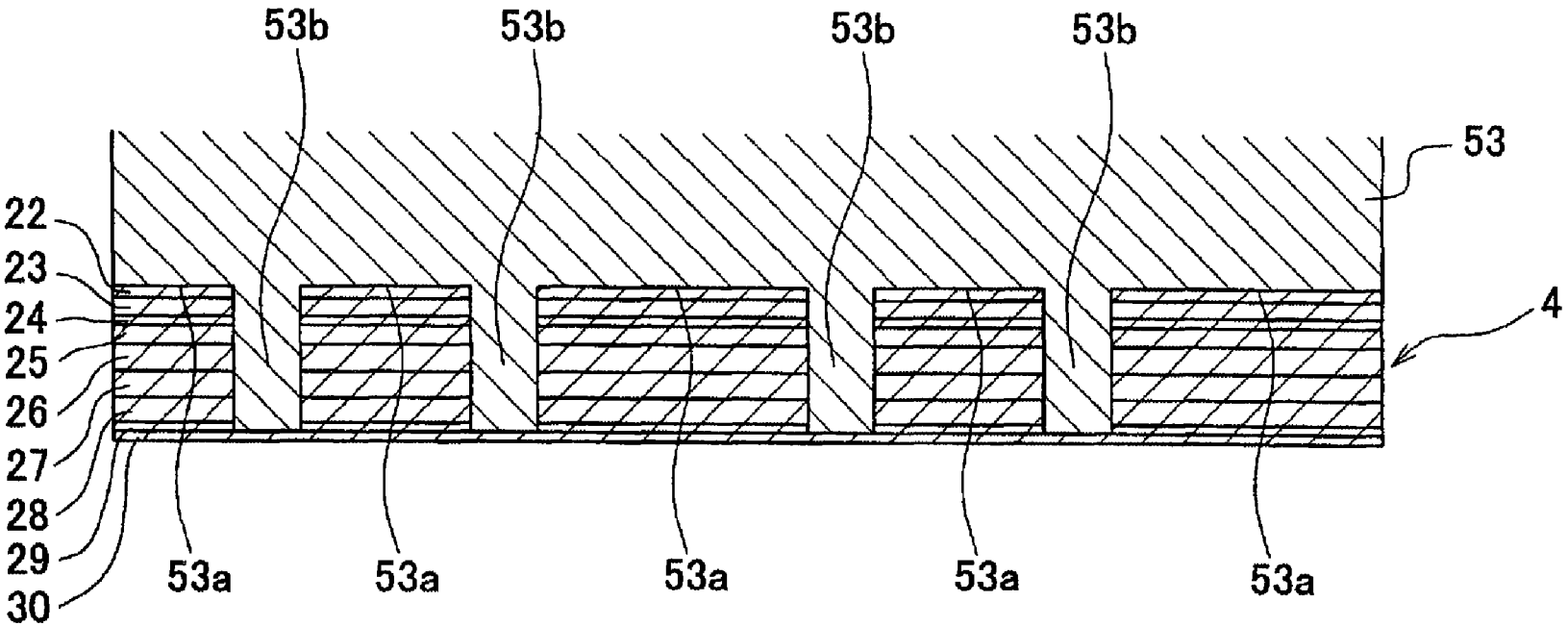
FIG. 10 is a sectional view of the ink-jet head as taken along line X-X in FIG. 2.

Next, the protective casing will be described in more detail with reference to FIGS. 1, 2, and 10. FIG. 10 is a sectional view as taken along line X-X in FIG. 2 showing a plan view of the passage unit. FIG. 10 shows a standing state of the side cover 53.

The side cover 53 is a plate-like member extending in a vertical direction in FIG. 1 and also in the lengthwise direction of the passage unit 4 which means a vertical direction in FIG. 2 and a horizontal direction in FIG. 10. An outer shape of the side cover 53 is a substantially rectangular. As shown in FIGS. 1 and 10, the side cover 53 has, at its lower end, peripheral linear portions 53*a* and protruding portions 53*b*. The peripheral linear portions 53*a* extend in parallel with the upper face of the passage unit 4, and adhere to the upper face of the passage unit 4. The protruding portions 53*b* protrude downward from the peripheral linear portions 53*a*. The protruding portions 53*b* are disposed corresponding to the grooves 4*a* of the passage unit 4. The protruding portions 53*b* are fitted with the corresponding grooves 4*a*, respectively, so that the side cover 53 is fixed to the passage unit 4.

As shown in FIG. 1, in a contact portion between the side cover 53 and the passage unit 4, a sealer 56 made of a silicone resin material or the like is applied from outside along the lengthwise direction. Here, since the peripheral linear portions 53*a* and the upper face of the passage unit 4 are in relatively good contact with each other, the sealer 56 is unlikely to flow into a gap between them. Even if there is a gap, the gap can be surely filled up. In addition, the sealer 56 surely fixes the side cover 53 to the passage unit 4.

Near both widthwise ends of the passage unit 4, the two side covers 53 extend over a substantially full length of the passage unit 4 with respect to the lengthwise direction thereof. With respect to the vertical direction, the two side covers 53 extend to a position higher than the reservoir unit 71 and the substrate 54. As a consequence, the reservoir unit 71, the COF 50, and the substrate 54 locate between the two side covers 53. The head cover 55 is made of the same metal material as that of the side cover 53. The head cover 55 is disposed so as to cover upper end portions of the two side covers 53. The reservoir unit 71, the COF 50, the substrate 54 and the like are placed within the enclosed space enclosed by the two side covers 53 and the head cover 55. As shown in FIG. 1, a sealer 56 is also applied from outside to a fitting portion between the side cover 53 and the head cover 55, thus more surely preventing intrusion of ink or ink mist from outside.

Next, modifications of this embodiment will be described. Members having the same constructions as in the above-described embodiment will be denoted by the common reference numerals, and descriptions thereof will appropriately be omitted.

Figure 11:
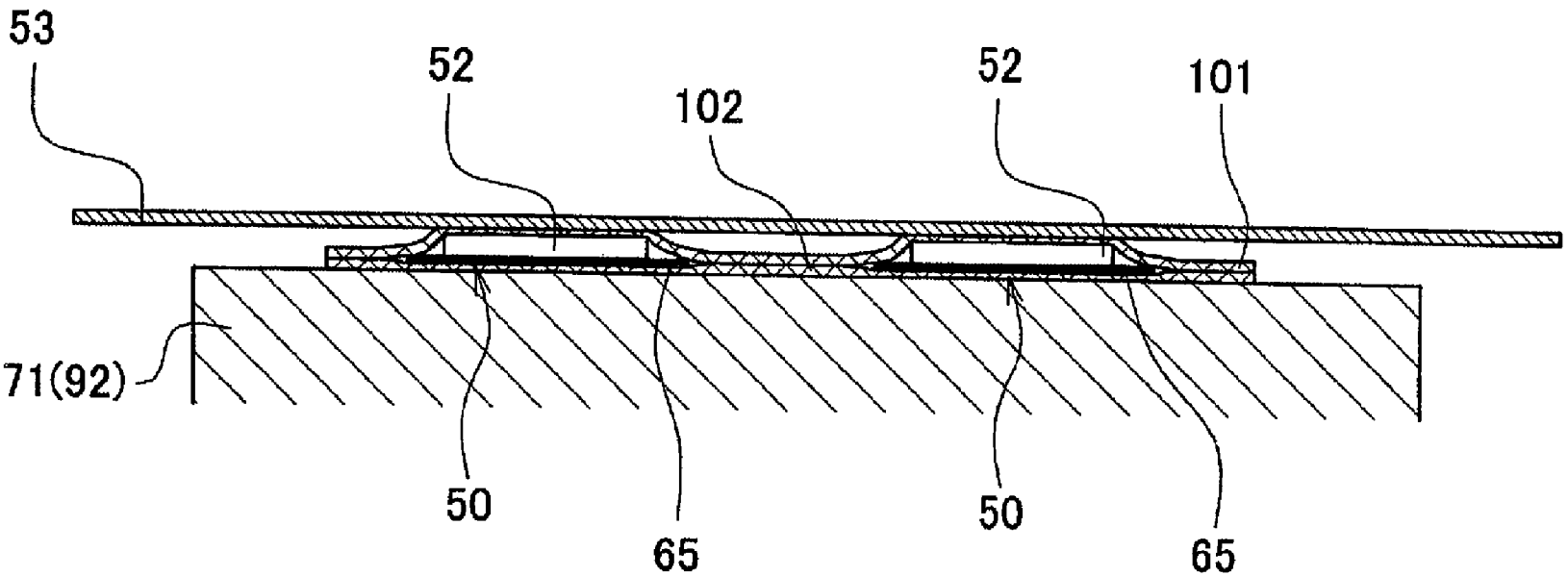
FIG. 11 is a counterpart of FIG. 9, and a partial sectional view of an ink-jet head according to a first modification.

It may be possible that a thickness of heat-transfer sheets 101 and 102 is smaller than a thickness of the driver IC chip 52, as shown in FIG. 11 (first modification). In this case as well, the heat-transfer sheets 101 and 102 extend outward beyond the outer periphery of the base 65, and adhere to each other at regions outside the base 65. Accordingly, heat generated in the driver IC chip 52 is transferred from the driver IC chip 52 through the heat-transfer sheet 101 to the side cover 53, and at the same time the heat is transferred through the heat-transfer sheets 101 and 102 to the filter plate 92. Like this, heat of the driver IC chip 52 is absorbed from the driver IC chip 52 through two routes. Therefore, even when the side cover 53 which functions as a heat sink is a small-size one, a temperature of the driver IC chip 52 is not excessively increased. It may be possible that the thickness of the heat-transfer sheets 101 and 102 is smaller than a thickness of the base 65.

Figure 12:
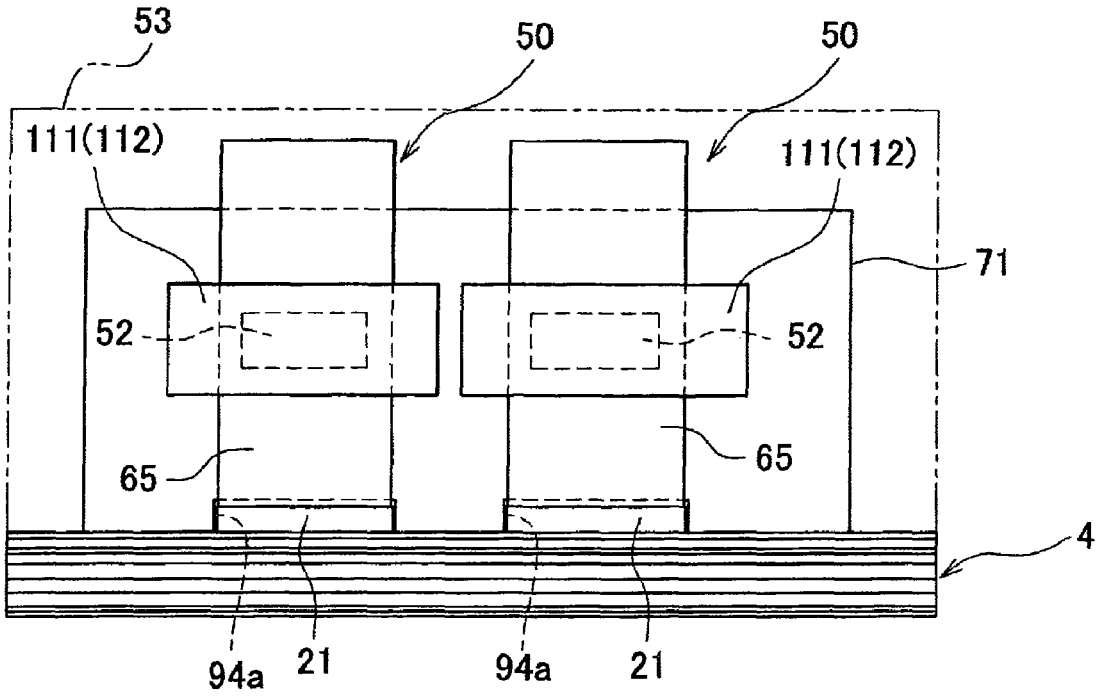
FIG. 12 is a counterpart of FIG. 8, and a side view of an ink-jet head according to a second modification.

As shown in FIG. 12, it may be possible that heat-transfer sheets 111 and 112 having a length greater than a width of the base of the COF 50 is provided for every COF 50 so as to extend beyond right and left peripheries of the COF 50. In this case, the heat-transfer sheet 111 and the heat-transfer sheet 112 adhere to each other at two regions outside the right and left peripheries of the base and not opposed to the COF 50 (second modification). In this case as well, heat of the driver IC chip 52 is absorbed from the driver IC chip 52 through two routes. Therefore, even when the side cover 53 which functions as a heat sink is a small-size one, a temperature of the driver IC chip 52 is not excessively increased.

Figure 13:
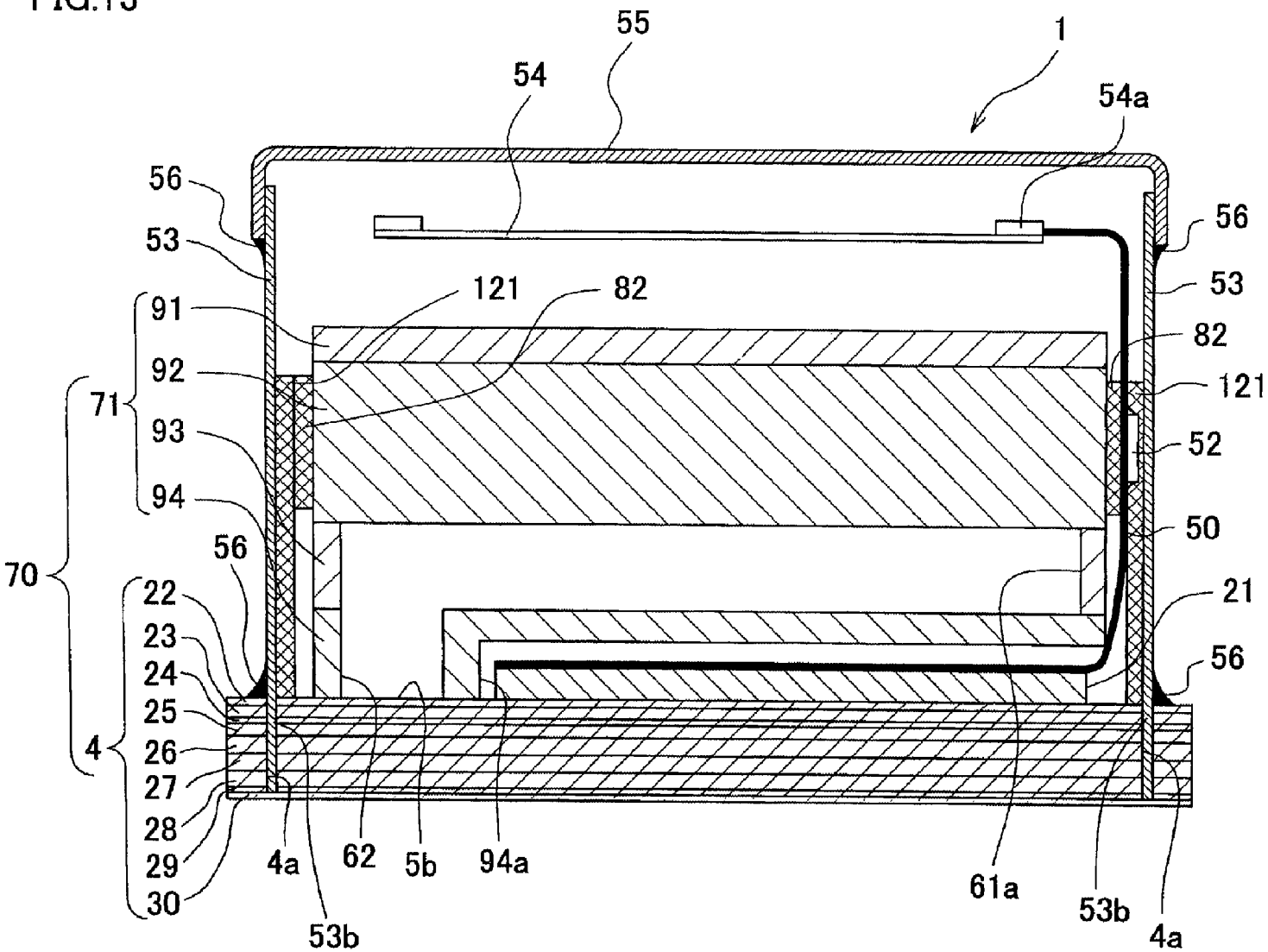
FIG. 13 is a counterpart of FIG. 1, and a longitudinal sectional view of an ink-jet head according to a third modification.

As shown in FIG. 13, it may be possible that a lower end of a heat-transfer sheet 121, which is disposed between the COF 50 and the side cover 53, adheres to the upper face of the passage unit 4 (third modification). In this modification as well, like in the above-described embodiment, the heat transfer sheet 121 adheres to the driver IC chip 52 and the base 65, while the heat-transfer sheet 82 adheres to the base 65 and the filter plate 92. The heat-transfer sheet 82 faces an opening of a gap that is formed between the reservoir unit 71 and the passage unit 4. Therefore, even if ink enters the head 1 from outside, the ink has more difficulty in reaching the surface of the piezoelectric actuator 21. As a result, short circuit of the individual electrodes 35 or the surface electrodes can be suppressed.

Figure 14:
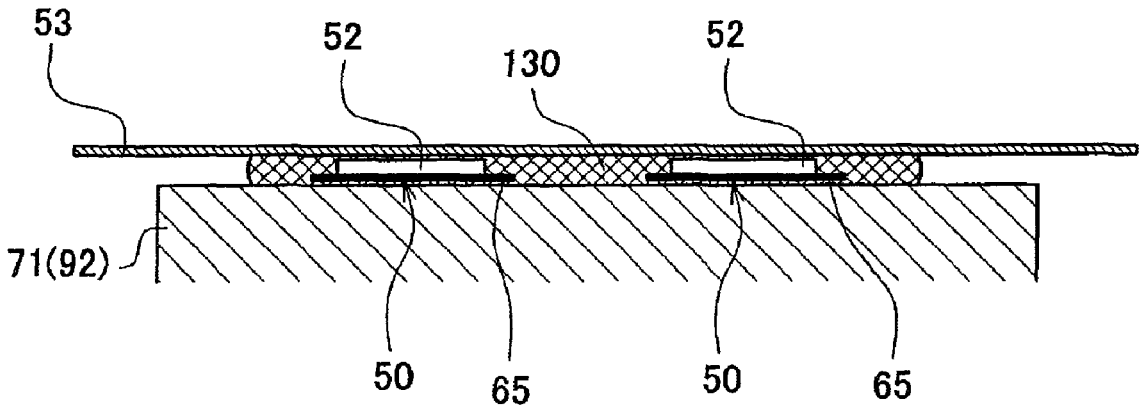
FIG. 14 is a counterpart of FIG. 9, and a partial sectional view of an ink-jet head according to a fourth modification.

As shown in FIG. 14, it may be possible that an adhesive 130, which is a filler having a high thermal conductivity, is filled in a space between the side cover 53 and the filter plate 92 (fourth modification). The adhesive 130 corresponds to an integration of the heat-transfer sheets 111 and 112 of the above-described embodiment. In this case as well, heat of the driver IC chip 52 is absorbed from the driver IC chip 52 through two routes. Therefore, even when the side cover 53 which functions as a heat sink is a small-size one, a temperature of the driver IC chip 52 is not excessively increased.

In a case where the heat-transfer sheet as in the above-described embodiment is adopted, the heat-transfer sheets are separated to form a narrow gap in the vicinity of the COF 50. In this modification, however, the filler 130 is filled in the space between the side cover 53 and the filter plate 92. Thereby, the space between the side cover 53 and the filter plate 92 can be tightly filled up with the filler 130, which makes heat transfer easier.

Figure 15:
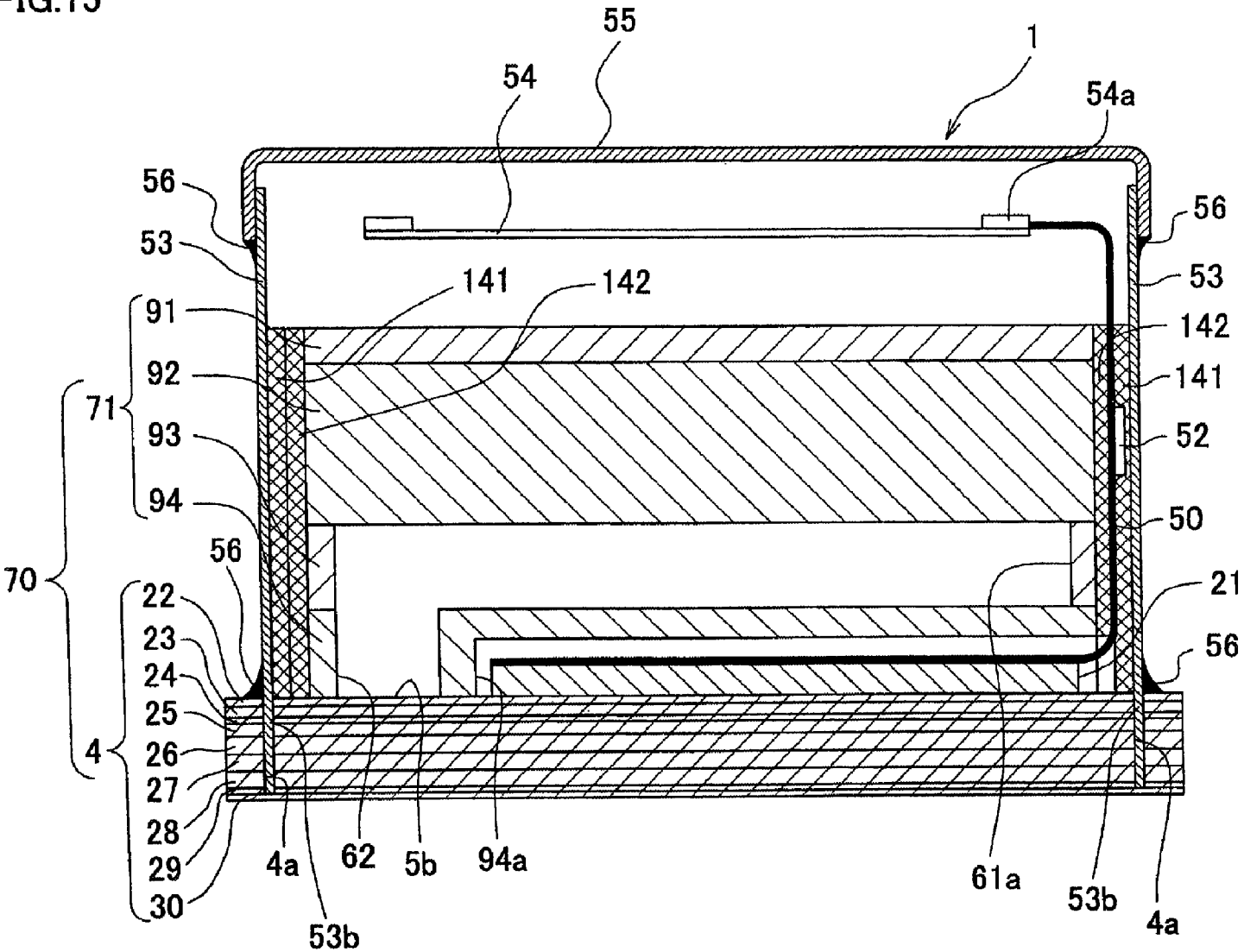
FIG. 15 is a counterpart of FIG. 1, and a longitudinal sectional view of an ink-jet head according to a fifth modification.

In the above-described embodiment, the heat-transfer sheets are disposed only at portions opposed to the filter plate 92. However, it may be possible that heat-transfer sheets 141 and 142 are disposed between the side cover 53 and the COF 50 and between the COF 50 and the reservoir unit 71, respectively, so as to be opposed to a whole side face of the reservoir unit 71, so that a space between the reservoir unit 71 and the side cover 53 is almost occupied by the COF 50 and the heat-transfer sheets 141, 142 (fifth modification) as shown in FIG. 15. Here, the heat-transfer sheet 142 is notched in its portion opposed to an opening of a gap. Through the notch, the COF 50 extends out. Lower ends of the heat-transfer sheets 141 and 142 except the notch reach the surface of the passage unit 4. Therefore, the heat-transfer sheets 141 and 142 almost tightly seal up a vicinity of the opening of the gap. Intrusion of ink from outside can be thereby prevented. Thus, electrical connection between the piezoelectric actuator 21 and the COF 50 can be surely kept good. Moreover, since an adherence area between the heat-transfer sheet 141 and the side cover 53 and an adherence area between the heat-transfer sheet 142 and the reservoir unit 71 are further increased, heat can be more easily transferred from the driver IC chip 52 to the side cover 53 and the reservoir unit 71. As a result, rise in temperature of the driver IC chip 52 can be prevented more effectively.

In the above-described embodiment, the reservoir unit 71 is made up of four metal plates 91 to 94. However, it may be also possible that only a part of the plates is made of a metal material while the other is made of a resin material or the like. That is, it suffices that at least a part of the reservoir unit 71 is a metal portion. In such a case, however, it is necessary to make the heat-transfer sheet 82 adhere to, among the plates 91 to 94 constituting the reservoir unit 71, the one made of the metal material.

In the description given above, the piezoelectric actuator 21 that applies pressure to ink contained in the pressure chamber 10 is adopted as an actuator for giving ejection energy to ink in the ink passage. However, other types of actuators driven by the driver IC chip 52 may be adopted in order to give ejection energy to ink in the ink passage.

While this invention has been described in conjunction with the specific embodiments outlined above, it is evident that a plurality of alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink jet head comprising:

a head main body including a metal portion and an ink passage which communicates with a nozzle which ejects an ink droplet;

an actuator which applies ejection energy to ink contained in the ink passage;

a power supply member which includes a base, and a driver IC chip which is mounted on the base and drives the actuator;

a heat sink which makes an outer surface of the ink jet head, and opposes the driver IC chip;

a first heat-transfer member which is positioned between the driver IC chip and the heat sink; and a second heat-transfer member which is positioned between the base and the metal portion, wherein the first heat-transfer member is in contact with the second heat-transfer member without interposition of the base, and both of the first heat-transfer member and the second heat-transfer member extend beyond a periphery of the base, and at a position beyond the periphery of the base, the first heat-transfer member is in contact with the second heat-transfer member.

2. The ink jet head according to claim 1, wherein the first heat-transfer member and the second heat-transfer member are heat-transfer sheets whose lengths are greater than a width of the power supply member.

3. The ink jet head according to claim 1, wherein:

the power supply member includes a plurality of power supply members; and the first heat-transfer member and the second heat-transfer member are disposed so as to extend over the plurality of the power supply members.

4. The ink jet head according to claim 1, wherein each of the first heat-transfer member and the second heat-transfer member has a thickness larger than each of a thickness of the base and a thickness of the driver IC chip individually.

5. The ink jet head according to claim 1, wherein a thermal conductivity of the heat sink is higher than that of the base.

6. The ink jet head according to claim 1, wherein the first heat-transfer member is in contact with the heat sink, at positions at which the heat sink is opposed to the driver IC chip and at positions at which the heat sink is not opposed to the driver IC chip.

7. The ink jet head according to claim 6, wherein a space between the heat sink and the head main body is almost occupied by the power supply member, the first heat-transfer member, and the second heat-transfer member.

8. The ink jet head according to claim 1, wherein:

the head main body includes a passage unit having the nozzle, a pressure chamber that communicates with the nozzle, and a common ink chamber that communicates with the pressure chamber, and a reservoir unit including the metal portion, fixed to one surface of the passage unit, and formed with an ink reservoir that stores therein ink to be supplied to the common ink chamber;

a gap with an opening is formed between the reservoir unit and the one surface of the passage unit;

the actuator applies pressure to ink contained in the pressure chamber and is positioned to the one surface of the passage unit within the gap; and the first heat-transfer member faces the opening of the gap and is contact with the one surface of the passage unit.

9. The ink jet head according to claim 1, wherein:

the first transfer-member is made of a filler that is filled in a space between the base and the heat sink so as to cover the driver IC chip; and the second transfer-member is made of a filler that is filled in a space between the base and the metal portion.

10. The ink jet head according to claim 1, wherein:

the base has a lower thermal conductivity than that of the metal portion; and a thermal conductivity of the first heat-transfer member and the second heat-transfer member is higher than that of the base.

* * * * *